United States Patent [19]

Stiel et al.

[11] 4,224,796

[45] Sep. 30, 1980

[54] METHOD FOR CONVERTING HEAT ENERGY TO MECHANICAL ENERGY WITH 1,2-DICHLORO-1,1-DIFLUOROETHANE

[75] Inventors: Leonard I. Stiel, Williamsville; Chien C. Li, Amherst, both of N.Y.

[73] Assignee: Allied Chemical Corporation, Morris Township, Morris County, N.J.

[21] Appl. No.: 973,269

[22] Filed: Dec. 26, 1978

[51] Int. Cl.[3] ..... F01K 25/06

[52] U.S. Cl. ..... 60/651; 60/671; 252/67

[58] Field of Search ..... 60/651, 671; 252/67

[56] References Cited

U.S. PATENT DOCUMENTS

| | | |
|---|---|---|
| 2,301,404 | 11/1942 | Holmes . |
| 3,162,580 | 12/1964 | Black et al. . |
| 3,234,738 | 2/1966 | Cook . |
| 3,282,048 | 11/1966 | Murphy . |
| 3,511,049 | 5/1970 | Norton et al. . |
| 3,516,248 | 6/1970 | McEwen . |
| 4,055,049 | 10/1977 | Murphy et al. . |

OTHER PUBLICATIONS

*Geothermal Energy*, J. H. Anderson, "The Vapor-Turbine Cycle for Geothermal Power Generation", Stanford University Press, 1973, Chapter 8.

*Primary Examiner*—Allen M. Ostrager
*Attorney, Agent, or Firm*—Jay P. Friedenson

[57] ABSTRACT

1,2-Dichloro-1,1-difluoroethane is useful as a power fluid with particular suitability for moderate scale Rankine cycle applications based on systems with moderate temperature heat sources. The fluid is utilized in a Rankine cycle application by vaporizing the fluid by passing the same in heat exchange relationship with a heat source and utilizing the kinetic energy of the resulting expanding vapors to perform work. In this manner heat energy is converted to mechanical energy. The fluid is particularly advantageous in a dual cycle system consisting of a Rankine power cycle combined with a vapor compression cooling or heating cycle.

6 Claims, No Drawings

METHOD FOR CONVERTING HEAT ENERGY TO MECHANICAL ENERGY WITH 1,2-DICHLORO-1,1-DIFLUOROETHANE

BACKGROUND OF THE INVENTION

The Government has rights in this invention pursuant to Grant No. GI-42056 awarded by the National Science Foundation.

Methods whereby heat energy, and particularly waste heat energy, is transformed into useful mechanical energy by vapor power (Rankine) cycles is well known. The basic method comprises causing a suitable working or power fluid to pass in heat exchange relationship with a source of heat of sufficient intensity to vaporize the fluid; utilizing the kinetic energy of the expanding vapors to perform work by passing them through a turbine machine or other work producing device, condensing the vapor and pumping the condensed liquid back in heat exchange relationship with the heat source to complete the cycle.

A variety of fluids have been tested in the past as power fluids for this type of application. Water or steam has been the most commercially utilized power fluid. However, the high boiling point, high critical pressure and low density of water or steam limit the power obtainable and result in a need for relatively large and bulky apparatus for these fluids.

A number of organic liquids have been tested as power fluids (e.g. U.S. Pat. Nos. 2,301,404; 3,162,580; 3,234,738; 3,282,048; 3,516,248; 3,511,049 and 4,055,049), but there has not been found any single fluid suitable for use as a power fluid for all applications.

The particular field of this invention relates to moderate scale Rankine cycle applications based on systems with moderate temperature heat sources. By moderate temperature heat sources is intended to mean on the order of about 200°–400° F. Illustrative of such applications are those involving geothermal power, waste heat and moderate scale solar power systems. 1,1,2-Trichloro-1,2,2-trifluoroethane (R-113) is recommended and utilized for applications of this type. Use of 1,1,2-trichloro-1,2,2-trifluoroethane, however, requires heat regeneration between the superheated vapor and the compressed liquid.

It is accordingly an object of this invention to identify a fluid which results in equal or higher cycle efficiencies than 1,1,2-trichloro-1,2,2-trifluoroethane but which does not require heat regeneration between the superheated vapor and the compressed liquid.

Other objects and advantages of the invention will become apparent from the following description.

SUMMARY OF THE INVENTION

It has been found that the objects of the invention are achieved by utilizing 1,2-dichloro-1,1-difluoroethane (R-132b) as a working fluid in a Rankine cycle application. In such application, heat energy is converted to mechanical energy by vaporizing a fluid comprising R-132b by passing the same in heat exchange relationship with a heat source and utilizing the kinetic energy of the resulting expanding vapors to perform work.

Methods for utilizing R-132b as a working fluid in Rankine cycle applications will be obvious and well understood by those or ordinary skill in the art. Such methods essentially involve converting heat energy to mechanical energy by vaporizing the working fluid by passing the same in heat exchange relationship with a heat source and utilizing the kinetic energy of the resulting expanding vapors to perform work. Such methods are not part of this invention. Detailed descriptions of various Rankine cycle applications and methods of using working fluids in such applications are given, for example, in U.S. Pat. No. 3,282,048. Such applications, methods and techniques are applicable herein.

EXAMPLE

In order to compare the performance of R-132b with R-113 in a typical moderate temperature Rankine cycle system, a comparison was made of the performance of these fluids. The comparison was based on the Rankine cycle efficiencies for these fluids. The data were based upon 100% turbine efficiency and although are not completely accurate on an absolute basis, are competent for the purpose of showing relative efficiency values.

In the typical moderate temperature Rankine cycle system chosen, a feed pump takes saturated liquid at low pressure and pumps it to high pressure. At this point the fluid enters the boiler where heat is applied. This causes the fluid temperature to increase until boiling is achieved. Further heating in the boiler vaporizes and superheats the fluid. The vapors are then passed through an expansion engine where they expand at constant entropy or nearly so dependent on the engine efficiency. During the expansion process, useful work is done by the expansion engine and the vapors exit at a lower temperature and pressure. The vapors are then cooled further in a condenser where they again reach saturation conditions. Further cooling causes the vapors to condense to the saturated liquid condition, thus completing the cycle.

The Rankine Cycle Efficiency (E) is given by:

$$E = \frac{\text{Turbine Work} - \text{Pump Work}}{\text{Boiler Heat}}$$

Table I compares the cycle parameters for R-132*b* and R-113 for a cycle operating at an expander inlet temperature of 400° F. and a condenser temperature of 120° F. The expander and pump efficiencies are 1.0 and the basis is 10,000 Btu/min as Boiler Heat.

Table I

| | R-132b | R-113 |
|---|---|---|
| Boiler Temperature (°F.) | 396.8 | 398.7 |
| Boiler Pressure (psia) | 482.1 | 426.9 |
| Mass Flow Rate (lb/min.) | 80.7 | 107.1 |
| Turbine Work (Btu/min.) | 2400 | 2275 |
| Temperature After Expansion (°F.) | 150.5 | 184.7 |
| Pump Work (Btu/min.) | 185 | 88.0 |
| Condenser Pressure (psia) | 15.93 | 15.36 |
| Volumetric Flow Rate at Turbine Outlet ($ft^3$/min.) | 237.1 | 249 |
| Efficiency × 100 | 23.2 | 21.9 |

For the purpose of the calculations of Table I, no heat regeneration was utilized between the superheated vapor after expansion and the compressed liquid. For R-132b, the temperature after expansion is closer to that of the saturated vapor (120° F.) and therefore the use of heat regeneration has a much smaller effect than for R-113. By way of example, if regenerative heat equal to 50% of the maximum possible heat recovery is utilized, the efficiencies for the same cycle conditions are 23.6 for R-132b and 23.2 for R-113. In order to obtain a comparable efficiency for R-113 in this manner, an additional heat exchanger is required, which increases the cost and operating difficulties of the system. It can also be seen from Table I that the volumetric flow rate at the turbine outlet is lower for R-132b, indicating that the size of turbine required for this fluid would be smaller than that required for R-113.

The efficiencies and cycle parameters were calculated from generalized thermodynamic relationships and data on the properties of the substances including critical constants and ideal gas heat capacities. The procedures employed are described in detail by Stiel et al. (Tenth Intersociety Energy Conversion Engineering Conference, Newark, Del., August, 1975). The important physical properties for the fluids utilized for these calculations are shown in Table II. These properties were experimentally determined.

Table II

PHYSICAL PROPERTIES OF R-132b AND R-113

| | R-132b | R-113 |
|---|---|---|
| Critical Temperature, °F. | 424.5 | 417.8 |
| Critical Pressure, psia | 600 | 494.7 |
| Boiling Point, °F. | 115.8 | 117.6 |
| Ideal Gas Heat Capacity at 80° F., Btu/lb. mole °F. | 23.58 | 30.44 |
| Molecular Weight | 135 | 187.4 |
| Liquid Density at 68° F., lb/ft$^3$ | 88.4 | 98.2 |
| Freezing Point, °F. | −150 | −31.0 |
| Critical Density, lb/ft$^3$ | 31.6 | 35.58 |

With identical cycles operated with R-132b and R-113 at other expander inlet temperatures, similar results are obtained, that is to say, that no heat regeneration is required with R-132b as is the case with R-113 and lower volumetric flow rates are obtained with R-132b.

The use of R-132b is particularly advantageous in a dual cycle system consisting of a Rankine power cycle combined with a vapor compression cooling or heating cycle. In other words, the kinetic energy of the resulting expanding vapors from the power cycle are utilized to drive a compressor in a vapor compression heating or cooling cycle. In a system of this type it is desirable to utilize the same working fluid in the power and compression cycles for mechanical simplicity. The fluid R-132b is a considerably better refrigerant than R-113, particularly if the compression cycle is operated at elevated temperatures.

An example of such an application is an industrial waste heat system consisting of a Rankine power plant combined with a high temperature heat pump. For a compression cycle operating with an evaporator temperature of 120° F. and a condenser temperature of 260° F., the coefficient of performance (COP=Evaporator Heat Input/Compressor Work) is about 18% higher for R-b 132b than for R-113. For an upper Rankine cycle temperature of 400° F., condenser temperatures of 260° F., and no heat regeneration, the overall dual cycle of efficiency (E×COP) is 23% higher for R132b than for R-113. Further, the volumetric capacity in the compressor is 30% higher for R-132b for this case than it is for R-113.

Additives, such as lubricants, corrosion inhibitors and others may be added to the R-132b working fluid for a variety of purposes provided they do not have an adverse influence on the fluid for the intended application.

We claim:

1. The method for converting heat energy to mechanical energy which comprises vaporizing a fluid comprising 1,2-dichloro-1,1-difluoroethane by passing the same in heat exchange relationship with a heat source and utilizing the kinetic energy of the resulting expanding vapors to perform work.

2. The method according to claim 1, in which the heat source is on the order of about 200°–400° F.

3. The method according to claim 1 in which the kinetic energy of the resulting expanding vapors is utilized to drive a compressor in a vapor compression heating or cooling cycle.

4. The method according to claim 1 in which the heat source is on the order of about 200°–400° F.

5. The method according to claim 3 in which the refrigerant in the vapor compression heating or cooling cycle is 1,2-dichloro-1,1-difluoroethane.

6. The method according to claim 5 in which the heating source is on the order of about 200°–400° F.

* * * * *